US005447249A

United States Patent [19]

Vickers

[11] Patent Number: 5,447,249

[45] Date of Patent: Sep. 5, 1995

[54] INTERENGAGING CONTAINERS

[76] Inventor: Robert V. Vickers, 147 Hawthorne Dr., Chagrin Falls, Ohio 44022

[21] Appl. No.: 200,579

[22] Filed: Feb. 22, 1994

Related U.S. Application Data

[63] Continuation of Ser. No. 941,208, Sep. 4, 1992.

[51] Int. Cl.[6] ..... B65D 81/36

[52] U.S. Cl. ..... 220/23.83; 220/23.4; 206/511

[58] Field of Search ..... 220/23.83, 23.4, 23.6; 206/509, 511, 512; 446/77, 76, 117, 120, 74, 73, 116

[56] References Cited

U.S. PATENT DOCUMENTS

| | | | |
|---|---|---|---|
| 3,303,965 | 2/1967 | Parker et al. | 220/97 |
| 3,670,449 | 6/1972 | Lemkin et al. | 46/23 |
| 3,815,281 | 6/1974 | Kander | 46/11 |
| 4,067,475 | 1/1978 | Pinkau et al. | 220/23.4 |
| 4,106,657 | 8/1978 | Dogliotti | 220/23.4 |
| 4,107,894 | 8/1978 | Mullins | 52/592.6 |
| 4,170,082 | 10/1979 | Freedman | 46/29 |
| 4,509,930 | 4/1985 | Schweigert et al. | 446/116 X |
| 4,565,043 | 1/1986 | Mazzarese | 52/592.6 |
| 4,919,268 | 4/1990 | Young et al. | 206/509 |
| 5,054,617 | 10/1991 | Young et al. | 206/509 |
| 5,054,636 | 10/1991 | Netzer | 220/23.4 |
| 5,150,804 | 9/1992 | Blanchet et al. | 206/512 X |

FOREIGN PATENT DOCUMENTS

| | | |
|---|---|---|
| 1513472 | 2/1968 | France . |
| 2276236 | 1/1976 | France . |
| 2414348 | 8/1979 | France . |
| 2429163 | 1/1980 | France . |
| 2727461 | 1/1979 | Germany . |

*Primary Examiner*—Stephen J. Castellano
*Attorney, Agent, or Firm*—Vickers, Daniels & Young

[57] ABSTRACT

A container for the sale of edible foods which, when empty, can be combined with other containers to serve as a children's toy. Each container has top and bottom ends and a laterally extending flange at the top end. The container has respective, mutually interlocking connection parts comprising pegs and complementary openings or recesses which enables a plurality of containers to be assembled together. The openings or recesses are in the flange and the pegs are on the bottom of the container, and the openings impart a clamping force on the pegs when two containers are interengaged so that the containers fit tightly together.

8 Claims, 4 Drawing Sheets

INTERENGAGING CONTAINERS

This is a continuation of application Ser. No. 941,208, filed Sep. 4, 1992.

The present invention relates to an improvement for a container which can be used for the sale of foods and other items and subsequently used as a toy or building system.

INCORPORATION BY REFERENCE

Young et al 5,054,617, Young et al 4,919,268, Pinkau et al 4,067,475 and Parker et al 3,303,965 are incorporated by reference herein so that background container systems known in the art need not be described in detail herein.

BACKGROUND OF THE INVENTION

There are a number of different containers of varying geometric configurations, including cylindrical and box-like containers used for the sale of food products including yogurt. These containers are typically made of disposable material and after having been emptied, are thrown away. Certain attempts have been made to find another useful purpose for the single use containers. The Young patents and Pinkau disclose food containers, which, when empty, serve as an assembly construction kit for children. In such an assembly, a number of containers are provided with interengageable connection parts in order that a structure comprised of a number of the containers can be constructed.

Young et al 5,054,617 and Young et al 4,919,268 are directed to containers which can be later used in conjunction with other similar containers, as a construction kit. The containers disclosed in Young include connection parts comprised of holes, projections and a cruciform; the holes located adjacent but spaced within a peripheral flange. The projections of one container are designed to fit within the holes of an adjacent container in order that two containers are interconnected. In order that the intended structure shown in Young fit snugly together, close tolerances between the holes and projections are required. These close tolerances are important so that the assembled containers stay together when subjected to the abuses of small children. It is not economical to manufacture such containers with precise dimensions, especially since the food within the containers, and not the containers themselves, are the primary product. Therefore, the connection parts fit loosely together resulting in containers that do not stay fitted together, much to the disappointment of small children.

Pinkau et al 4,067,475 discloses a container assembly system using a projection and recess system. Each container utilizes a peripheral bead at the end of a flat edge as the projection component. The container has a base support which contains a slot that opens into a round recess. The bead of one container fits into the recess of another container and is held in place in only one direction since the bead cannot slide out the slot. However, it is impractical to manufacture a bead and recess to close tolerances to ensure a tight fit between the recess and the bead. The forming and cutting dies generally used to manufacture such containers in volume do not retain close tolerances after repeated uses. Therefore, even though the bead will not fit through the slot, the bead can easily slide out of the recess, resulting in containers not fitting snugly together, and susceptible to becoming disconnected upon even casual handling.

Parker et al 3,303,965 describes plastic stackable containers. Each container has a flange with an inner peripheral edge with recesses and ribs at the bottom portion. The container fits within another container by seating of the ribs of the upper container within the inner peripheral edge of the flange of the lower container. The stacking characteristics do not provide for building structures of differing configurations and are designed for utilitarian purposes, not as toys for small children. Importantly, the ribs fit loosely into the inner edge. Therefore, the container system of Parker consists of individual containers loosely stacked. The entire system of Parker cannot be moved intact by picking up only one container.

The above described prior art discloses containers which, when fitted together, are loosely engaging. When the complementary connection parts consist of projections and holes, it is impractical and uneconomical to manufacture the parts to the necessary close tolerances which would result in a tight or snug fit between complementary parts. The resultant containers have loosely engaging connection parts. The containers are easily disconnected and toppled, much to the disappointment of small children. The containers cannot be picked up and moved as a unit without falling apart. Additionally, prior art containers cannot be placed or constructed on their sides without the connection parts disengaging.

SUMMARY OF THE INVENTION

The present invention overcomes the disadvantages of the prior art containers by providing a container having respective, mutually engagable connecting parts at the top and bottom end of the container which, when engaged with complementary connection parts of another container, provides a resilient clamping force therebetween. Further, the container has a top end having a laterally extending annular flange and a bottom end. The flange and bottom end of the container have the connecting parts which enable a plurality of containers to be interconnected.

The connection parts are comprised of an opening or recesses and complementary pegs. Preferably, the pegs and recesses are respectively located at the bottom and top ends of the container with the recesses located within the flange. A peg of one container is inserted into a recess of an adjacent container, and a clamping force is used to keep the peg engaged in the recess and prevent inadvertent removal. The clamping force is provided by the dimensional characteristics of the peg in relation to the recess, at least a portion of the recess being smaller than the peg to provide a clamping engagement with the peg. The recess can be circular and closed, or arcuate and more than 180°. The clamping force is provided by the radial displacement or distortion of the flange material adjacent the recess when the peg is inserted in the recess. In this respect, the larger peg being inserted in the smaller recess causes radial displacement or distortion of the flange adjacent the recess, which thereby causes the clamping force.

Preferably, at the entry point where the peg is first inserted into the recess the peg is smaller than the recess in order that the peg can slide easily into the recess. As the peg is slidably engaged with the recess, the peg comes into contact with the recess to cause distortion of the flange material and create the clamping force.

Clamping contact is provided by a portion of the peg being larger than a complementary portion of the recess. This can be accomplished, for example, by tapering either the side wall of the peg or the recess or both.

Further in accordance with the present invention there is provided a building assembly comprised of a plurality of containers. Each of the containers has respective mutually engagable pegs and recesses at the top and bottom of the container for engaging with another container within the assembly. Adjacent containers are held together by a resilient clamping force which is imparted by one container to the other as the peg of the one container is inserted into the recess of the other adjacent container.

The resilient clamping force in accordance with the present invention provides a snug fit between adjacent containers. This advantageously avoids having to rely on close tolerances between interengageable container connection parts to obtain a tight fit. The practical result is that the containers can be economically produced in large volumes in that close tolerances are not required. Furthermore, the clamping force assures a tight fit between the connection parts in conjunction with repeated assembly and disassembly of the containers, thus extending the useful life thereof as a toy. Moreover, the clamping force enables a building assembly of containers to have a structural integrity which can withstand the abuses of small children, such as being pushed or toppled, thus preventing the disappointment of children and the aggravation of their parents.

Thus, it is a principal object of the invention to provide an improved arrangement of interconnecting parts between two containers which enables a plurality of containers to be snugly interengaged so as to construct a tower or the like.

It is another object of the invention to provide containers with interconnecting parts which snugly fit together and which, when assembled, have structural integrity against separation when pushed or toppled by small children.

Still another object of the invention is to provided containers of the foregoing character which can be manufactured more economically than heretofore possible.

Yet another object of the present invention is to provide a container having interconnection parts which can be manufactured with large tolerances, whereby the containers can be manufactured economically, yet provide for the interconnecting parts to tightly fit together.

Still another object of the present invention is to provide a container arrangement having mutually engaging connection parts, of which one connection part provides a clamping force to the other connection part so that adjacent containers fit snugly together.

Further, another object of the present invention is to provide an improved container construction by which small children can more enjoyably practice their coordination skills and exercise their imagination.

Another object of the invention is to provide a container capable of accommodating edible foodstuffs and having improved connecting arrangements by which the containers, when empty, can be combined with other empty containers to provide a building system for the enjoyment and educational use of small children.

BRIEF DESCRIPTION OF THE DRAWINGS

The foregoing and other objects of the invention will become apparent to those skilled in the art upon reading and understanding the following detailed description of preferred embodiments of the invention shown in the accompanying drawing which.

DESCRIPTION OF PREFERRED EMBODIMENTS

Figure 1:
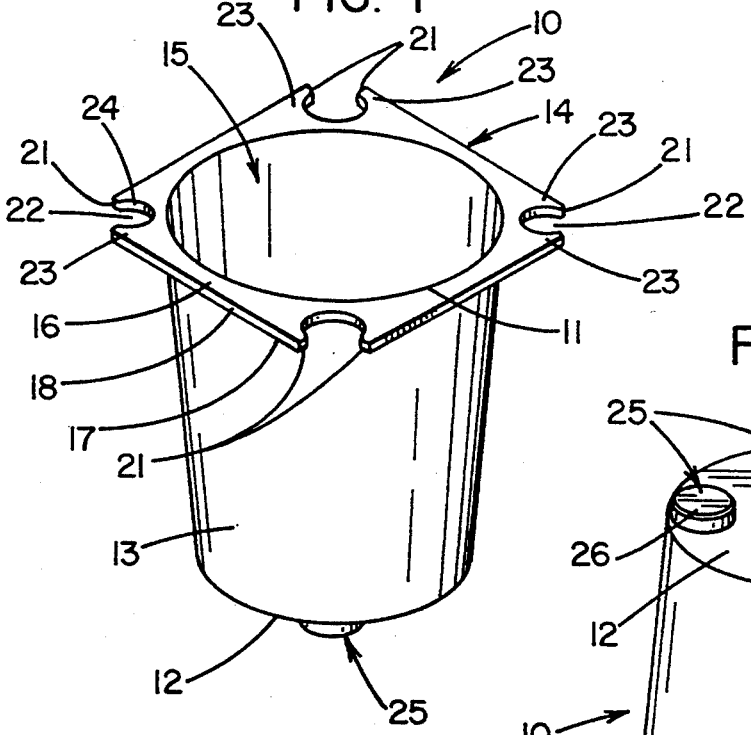
FIG. 1 is a pictorial view illustrating a container having connecting parts according to the present invention.
Figure 2:
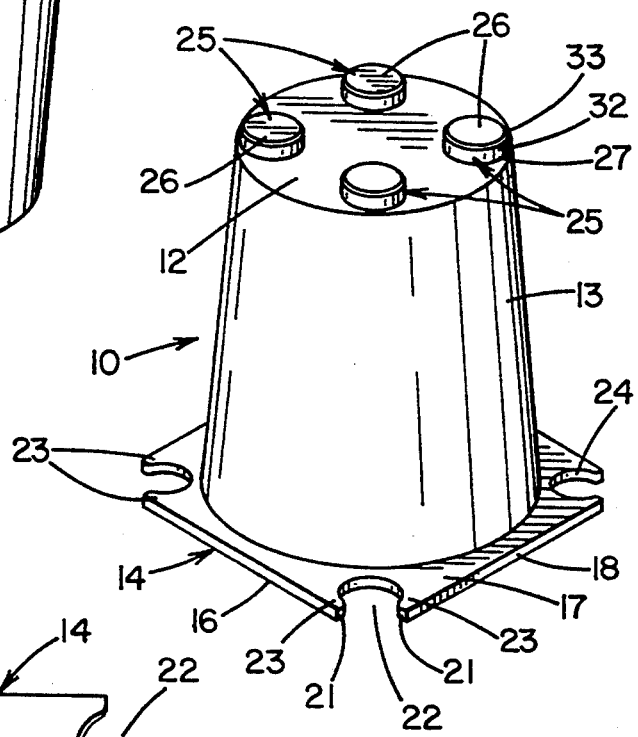
FIG. 2 is a pictorial view of the bottom of the container shown in FIG. 1.

Referring now to the drawings, wherein the showings are for the purpose of illustrating preferred embodiments of the invention only and not for the purpose of limiting same, FIGS. 1 and 2 show a container 10 having opposite ends defined by an upper edge 11 and a bottom wall 12 connected by an annular side wall 13. The upper end of container 10 has a square or rectangular peripheral flange 14 which extends radially outwardly from upper edge 11. The peripheral flange 14 is parallel to bottom wall 12.

Figure 3:
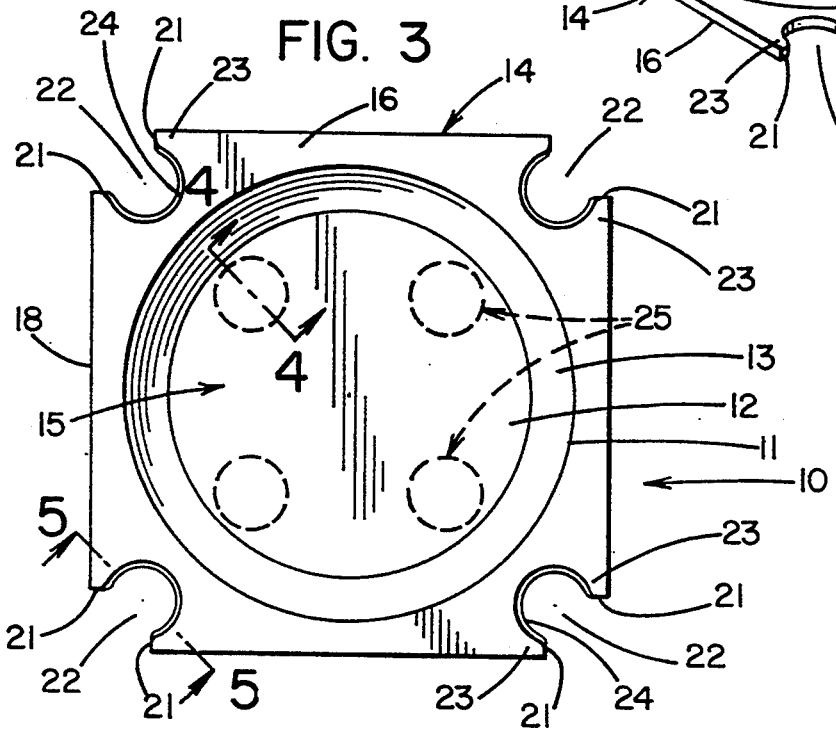
FIG. 3 is a top view of the container shown in FIG. 1.

As seen in FIGS. 1–3 of this embodiment, container 10 has a generally circular cross sectional configuration. Container 10 is wider at peripheral flange 14 than at bottom wall 12, and open end 15 of container 10 preferably is wider than bottom 12 for allowing easy access to the foodstuffs within the container. Bottom wall 12 provides a closed end for containment of foods within container 10, and both bottom wall 12 and peripheral flange 14 provide surfaces by which the container can sit on an underlying support, thus providing a more stable container 10 with which other containers may be assembled as will become apparent hereinafter.

Peripheral flange 14 is further defined by an upper side 16 and a lower side 17, the upper side 16 extending from upper edge 11 and lower side 17 extending from annular side wall 13. Flange sides 16, 17 of flange 14 terminate at an outer peripheral edge 18 which is perpendicular to sides 16, 17. The edge 18 is further defined by corner edge portions 21 which are at right angles to peripheral edge 18. Peripheral flange 14 further includes four recesses 22, each of which defines one of the connection parts in accordance with the present invention. Each recess 22 is located between two peripherally adjacent corner edge portions 21 of flange 14. Each recess 22 shown has a circular contour and is of open C-shape with each end of the "C" connected to a corresponding corner edge portion 21. Recesses 22 are thus located at the corners of flange 14, open outwardly thereof and form peripherally opposed finger portions 23 at the open ends thereof. The C-shape of recesses 22 is best shown at FIG. 3. Each recess 22 has an arcuate wall 24 between sides 16 and 17 of flange 14 and having an angular extent which is greater than 180° to form finger portions 23. In the embodiment shown in FIGS. 1–7, recess walls 24 are tapered. More particularly, walls 24 taper inwardly from upper side 16 to lower side 17 of flange 14 whereby the recess has a minor diameter y at side 17, for the purpose set forth hereinafter, and a major diameter d at side 16. This configuration of recess 22 and opposed fingers 23 provides both a containing force and a clamping force to receive and hold a complementary connection part on another container as will be described in detail hereinafter.

The second connection part in this embodiment is a cylindrical peg which will snugly fit within recess 22 as will be described hereinafter. As shown in FIGS. 1–7, four pegs 25 extend from bottom wall 12 of container 10. As shown in FIG. 2, the four pegs are located on bottom wall 12 in diametrically opposed pairs. The pegs 25 are arranged so that a plurality of containers 10 can be interconnected as shown in FIG. 7 and described in greater detail hereinafter.

Figure 4:
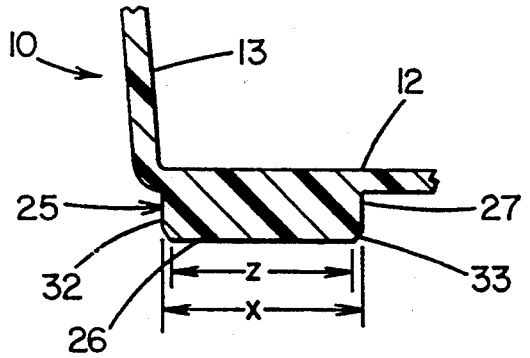
FIG. 4 is a cross-sectional view taken along line 4—4 of FIG. 3 and showing one of the connection parts of the container.

As seen in FIG. 4, peg 25 is preferably a solid projection integral with bottom wall 12 of container 10. It will of course be understood that peg 25 could be a hollow projection. Peg 25 includes a cylindrical side wall 32 which has a diameter x between terminal end 26 and flange end 27 thereof and which diameter is at least greater than minor diameter y of recesses 22. Preferably, the peg has a tapered portion 33 between side 32 and terminal end 26, whereby the diameter z of terminal end 26 is smaller than diameter x for the purpose described hereinafter. While side 32 is shown as cylindrical, it will be appreciated that peg 25 may have a tapering side 32 extending between flange end 27 and tapered portion 33.

Figure 5:
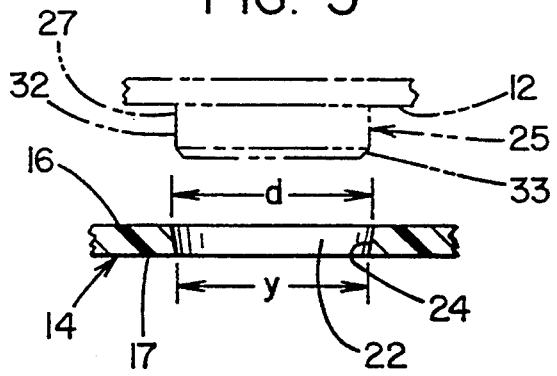
FIG. 5 is a cross-sectional view taken along line 5—5 of FIG. 3 and showing another of the connecting parts of the container.
Figure 6:
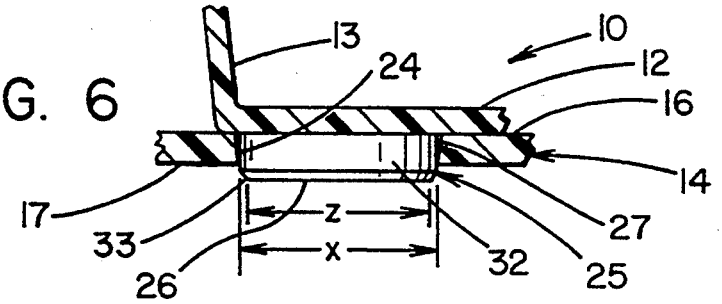
FIG. 6 is a detail view in section showing the parts of FIGS. 4 and 5 interconnected.
Figure 7:
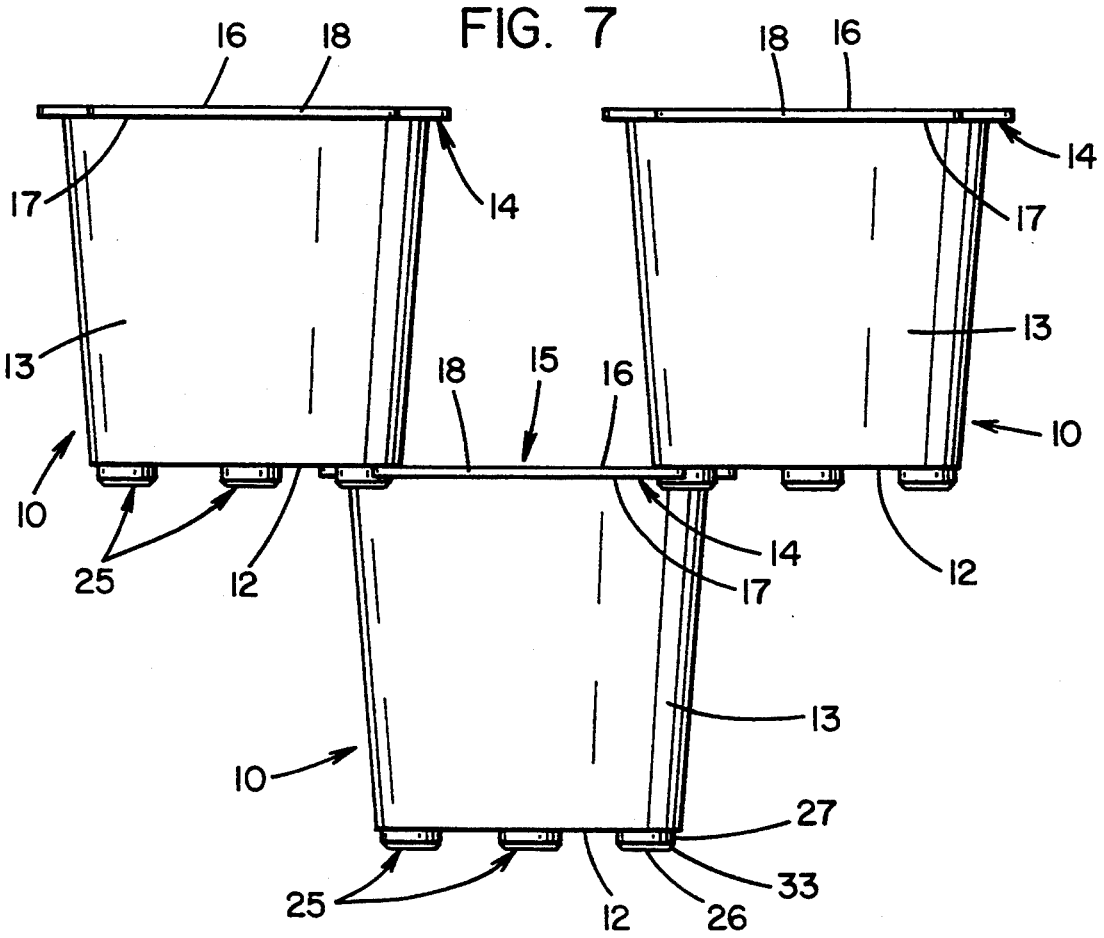
FIG. 7 shows an assembly of a plurality of the containers.

In FIGS. 5 and 6, a recess 22 is shown prior to and after interengagement with a peg 25 in the manner required for two of containers 10 to be interconnected. Since recess diameter y is less than peg diameter x, when peg 25 is inserted within recess 22 as shown in FIG. 6, recess side 24 will come into contact with side 32 of peg 25 and radially outwardly distend the recess, whereby the resiliency of the plastic material will provide a resilient clamping force which serves to grip and hold peg 25 within recess 22. Tapered portion 33 mentioned above assures ease with respect to inserting the larger peg in the smaller recess 22. The diameter z at terminal end 26 can be any diameter smaller than diameter x and, because of tapered portion 33, diameter x can be greater than major diameter d of the recess so long as the diameter z of end 26 is less than major diameter d of the recess. This allows initial engagement between peg 25 and recess 22 to assure radial distention of the recess free of any interference which would prevent sliding movement of the peg into the recess. More particularly in this respect, as terminal end 26 and tapered portion 33 slide into recess 22, peg side 32 engages tapered recess wall 24 and distends the recess to the extent that the diameter of peg side 32 and recess side 24 are equal. Thus, recess 22 radially expands due to the pressure peg 25 imposes on recess side 24 creating an elastic clamping force on peg 25.

Recess 22 is able to expand because the recess is open to peripheral edge 18. Specifically, finger portions 23 elastically open to allow the larger peg 25 to enter the smaller recess 22. The clamping force provided by finger portions 23 on peg 25 prevents easy or unintentional disengagement of assembled containers 10 from each other.

Moreover, the open C-shape of recess 22 provides for peg 25 to be displaced laterally into the recess between opposed fingers 23. At the same time, the fact that the arcuate extent of the C-shaped recess is greater than 180° enables recess 22 to clampingly hold a projection within the confines of recess side 24 so that peg 25 cannot easily slide out of recess 22 laterally.

It will be appreciated that containers 10 can be manufactured of any material as long as the material allows for elastic expansion when peg 25 is placed in recess 22 and engaged therein and has a resiliency which will impose a clamping force to grip peg 25.

FIG. 7 shows a container assembly comprising a plurality of containers 10 stacked with recesses 22 engaging pegs 25 of adjacent containers. It will be appreciated that additional containers can be added to those shown in FIG. 7 in order to create a large building assembly comprised of numerous containers 10. The building assembly can also be inverted 180° whereby the containers are resting on pegs 25 and not flanges 14 as shown or, likewise, the containers may be arranged 90° from the orientation shown in FIG. 7. Since a clamping force is imposed upon each peg 25 by the expansion of recess 22, a building assembly placed on its side or alternatively pushed over on its side, will not readily come apart.

Figure 11:
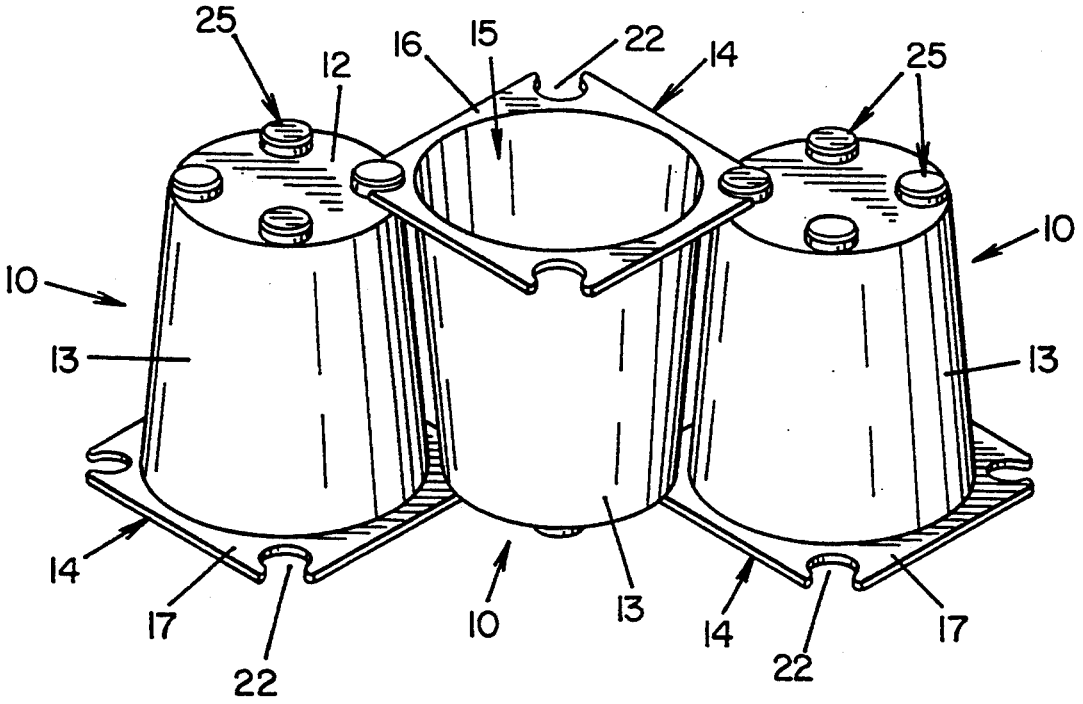
FIG. 11 shows an alternate assembly of a plurality of the containers.

FIG. 11 shows an alternate container assembly from that shown in FIG. 7. The three containers can be interlinked in the shown lateral arrangement. Two containers may be inverted wherein the pegs 25 and recesses 22 of at least one container are both interlinked with the corresponding peg 25 and recess 22 of an adjacent container. It will be appreciated that additional containers can be added to those shown in FIG. 11.

Figure 8:
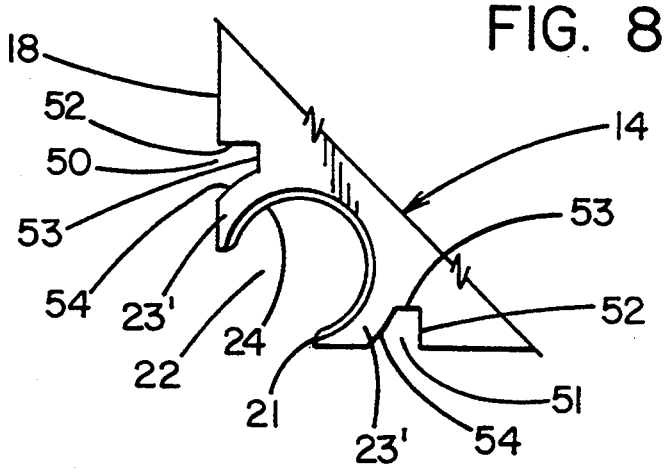
FIG. 8 is a plan view showing an alternative embodiment of one of the connection components of a container according to the invention.

Another embodiment of connecting components in accordance with the invention is shown in FIG. 8 in which two notches 50 and 51 are located adjacent to recess 22 in flange 14 to provide finger portions 23'. The notches 50, 51 are open to outer peripheral edge 18 and are defined by three sides 52, 53 and 54. Notch sides 54 provide finger portions 23' with an outer edge opposite the adjacent inner portion of recess side 24. The distance between notch side 54 and the adjacent recess side 24 is less then the diameter of recess 22. Thus, finger portions 23' in this embodiment can more easily elastically expand than the finger portions described in the first embodiment.

As peg 25 is inserted into recess 22 and engages therewith, finger portions 23' will open laterally to occupy the space of notches 50, 51. This displacement takes place because finger portions 23' are more elastically displaceable than they would be without notches 50, 51. This embodiment is desirable, for example, where heavier gage or less resilient plastic is used in the manufacture of containers 10 and increased resilience is therefore desired or necessary to enable a small child to join the parts. The embodiment further increases the allowable tolerance for manufacture of both pegs 25 and recesses 22 in comparison with the first embodiment, since the differential size between recess 22 and peg 25 can be greater.

Further, the addition of notches 50, 51 within flange 14 can increase the magnitude of the clamping forces which can be applied to a peg. All else being equal with respect to the component parts of the first embodiment and the present embodiment, a peg 25 inserted in recess 22 bounded by notches 50, 51 is subject to a smaller clamping force than would be applied to peg 25 inserted in recess 22 shown in FIG. 3, since finger portions 23' shown in FIG. 8 are more easily spread and are more elastic than finger portions 23 shown in FIG. 3. However, peg 25 in the present embodiment can have a greater diameter than peg 25 in the first embodiment and thereby force finger portions 23' to be spread wider than with the smaller diameter peg. The increased spreading increases the return bias of the fingers and, in this manner, the clamping forces provided on peg 25 can be increased.

Figure 9:
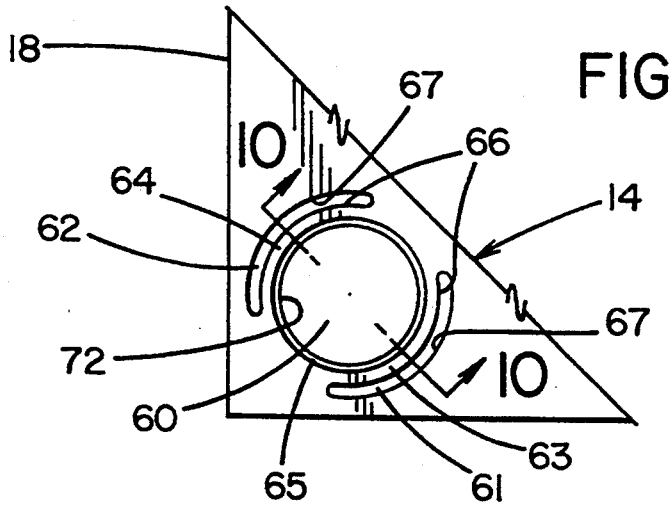
FIG. 9 is a plan view showing another embodiment of one of the connector parts of a container according to the invention; and, FIG. 10 is a cross-sectional view taken along line 10—10 of FIG. 9.
Figure 10:
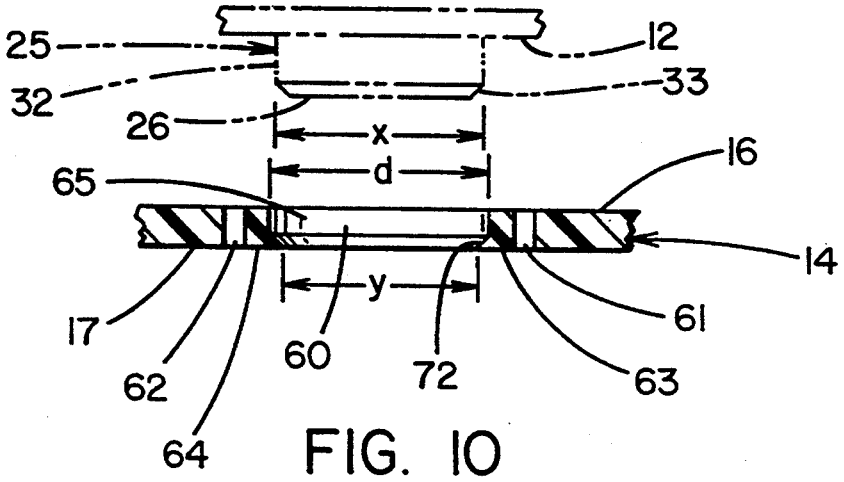

A further embodiment of the present invention is shown in FIGS. 9 and 10 in which a corner portion of a container flange 14 is shown with a circular opening 60. As shown in FIG. 9, opening 60 is located within flange 14 and is not open to peripheral edge 18 as in previous embodiments. As shown in FIG. 9, flange 14 has diametrically opposed expansion slots 61, 62 located substantially adjacent and concentric to opening 60. Separating expansion slots 61, 62 from opening 60 are flange portions 63 and 64, respectively. When a peg 25 of larger diameter than that of opening 60 is inserted within the opening, the opening will deform radially outwardly by moving flange portions 63, 64 into the space defining expansion slots 61, 62, thus imposing a clamping force on the peg. Slots 61, 62 are shown concentric but need only be concomitant to opening 60. Preferably, as shown, opening 60 is concentric with respect to both the inside arc 66 and the outside arc 67 of slots 61, 62. The two expansion slots are within flange 14 in order to allow diametrically opposed expansion of opening 60. However, the necessary expansion to obtain the desired clamping force will still result if only one, or more than two, expansion slots are provided.

As shown in FIG. 10, and like the previous embodiments, peg 25 has a diameter x while opening 60 has a major diameter d and a minor diameter of y. In this embodiment, opening 60 has a cylindrical inside periphery 65 providing major diameter d and a radially inwardly extending lip portion 72 at the lower end of inner periphery 65 and providing minor diameter y. With lip 72 located within opening 60, peg 25 need not engage inside periphery 65 to create a clamping force. Instead, peg 25 engages lip portion 72 to cam flange portions 63, 64 into slots 61, 62 expanding opening 60 laterally outwardly. It is not necessary that lip portion 72 extend around the entire inside periphery 65 of opening 60. It is sufficient if a lip portion is placed along a portion of inside periphery 65 of opening 60 corresponding to slots 61, 62. It will be appreciated that a lip corresponding to lip portion 72 may be incorporated in any of the previous embodiments described herein and that the recesses in the previous embodiments can be contoured to provide a cylindrical inner side and lip portion rather than the tapered contour shown in the drawings.

The invention has been described with reference to the preferred embodiments. Obviously modifications and alterations will occur to others upon the reading and understanding of this specification. For example, it is contemplated that flange 14, shown as a square on the drawings, may be circular or any other geometric shape having diametrically opposed pairs of recesses or openings thereabout. Additionally, the number and shape of the recesses and openings may vary, as well as the number and shape of the pegs, and the locations thereof on the container. In this respect, the pegs, openings and recesses may take alternate shapes from circular shapes shown in the drawings as long as the shapes are complementary and cooperate to provide a clamping force on the peg when the peg is inserted within the opening or recess. Additionally, peg 25 can be tapered and the inner side of the recess can be cylindrical to provide a clamping force. Additionally, by appropriate dimensioning, the clamping force can be provided by a tapered peg and tapered recess.

It will also be appreciated that container 10 can also include a flange similar to flange 14 at bottom wall 12. Such a flange would provide a greater surface area at the bottom end on which the container sits thus providing a more stable container. A flange at the bottom of the container could be provided with pegs projecting upwardly and/or downwardly therefrom for fitting into recesses or openings in a flange 14 located at the open end of the container and thus increasing the versatility with respect to assembling a plurality of containers. Further in connection with such versatility, each flange at the top and bottom could include both pegs and recesses and/or openings.

It is intended to include such modifications and alterations as described above and others in so far as they come within the scope of the appended claims.

Having thus described the invention, it is claimed:

1. A container assembly comprising a primary container having top and bottom ends, said top end of said primary container having a laterally outwardly extending flange, said flange and bottom end having respective mutually interengaging connection means interconnecting with an identical secondary container, said connection means at one of said flange and bottom end of said primary container clampingly interengaging with said connection means at the other of said flange and bottom end of said secondary container when said primary container and said secondary container are assembled, said connecting means including an opening through said flange, and said flange having at least one slot adjacent to said opening for radial expansion of said opening.

2. The container assembly of claim 1, wherein said flange has an outer periphery, and said opening includes a recess in said flange connecting said opening and said outer periphery.

3. The container assembly of claim 2, wherein said flange has upper and lower sides and said recess includes a recess wall tapering downwardly and inwardly from said upper side toward said lower side.

4. The container assembly of claim 2, wherein said flange includes notches in said outer periphery located on peripherally opposite sides of said recess.

5. The container assembly of claim 1, wherein said connecting means further includes a plurality of pegs extending from said bottom end of said container, said opening is circular in shape, and said slot is an expansion slot adjacent said opening.

6. The container assembly of claim 5, wherein said at least one slot includes a pair of arcuate expansion slots on diametrically opposite sides of said opening.

7. The container assembly of claim 5, wherein said circular opening has an inner periphery and a lip extending and projecting radially inwardly from said inner periphery.

8. A primary container comprising top and bottom ends, said top and bottom ends for interconnecting with at least one secondary container having top and bottom ends, said primary and said secondary container having respective mutually interengaging connection means at said top and bottom ends, each said container cooperating to provide a means for providing a clamping force on said connection means, said connection means at one of said top and bottom ends of said primary container clampingly interengaging with said connection means at the other of said top and bottom ends of said secondary container when said containers are assembled, said top end connection means of said primary container comprising at least one opening for clampingly interengaging with said bottom end connection means of said at least one said secondary container and said bottom end connection means of said primary container comprising at least one peg for interengaging with another secondary container, said means for providing a clamping force including said opening having an inner peripheral edge and said opening having a lip extending radially inwardly from said inner peripheral edge, said lip having an inner diameter, said peg having a diameter equal to or slightly greater than said inner diameter whereby said clamping force is provided when said peg is interengaged with said opening, said primary container including means for allowing expansion of said opening upon interengagement with said peg, said top end of said primary container including a flange having a periphery, said means for providing expansion including providing each said opening on said periphery.

* * * * *